United States Patent [19]

Otobe et al.

[11] 4,454,855

[45] Jun. 19, 1984

[54] FUEL SUPPLY CONTROL METHOD AND SYSTEM FOR INTERNAL COMBUSTION ENGINES EQUIPPED WITH EXHAUST GAS RECIRCULATION CONTROL SYSTEMS

[75] Inventors: Yutaka Otobe, Shiki; Noriyuki Kishi, Tokyo, both of Japan

[73] Assignee: Honda Motor Co., Ltd., Tokyo, Japan

[21] Appl. No.: 510,403

[22] Filed: Jul. 1, 1983

[30] Foreign Application Priority Data

Jul. 8, 1982 [JP] Japan ..... 57-118940

[51] Int. Cl.[3] ..... F02M 25/06

[52] U.S. Cl. ..... 123/571; 123/569; 364/431.06; 180/309

[58] Field of Search ..... 123/571, 569; 364/431.06; 180/309

[56] References Cited

U.S. PATENT DOCUMENTS

| | | | |
|---|---|---|---|
| 4,165,722 | 8/1979 | Aoyama | 123/571 |
| 4,191,144 | 3/1980 | Nohira et al. | 123/571 |
| 4,233,947 | 11/1980 | Abo | 123/571 |
| 4,257,381 | 3/1981 | Yuzawa et al. | 123/571 |
| 4,279,235 | 7/1981 | Flaig et al. | 123/571 |
| 4,280,469 | 7/1981 | Ganoung | 123/571 |
| 4,304,210 | 12/1981 | Hayakawa | 123/571 |
| 4,318,385 | 3/1982 | Yamaguchi | 123/571 |
| 4,333,440 | 6/1982 | Eheim | 123/569 |
| 4,380,988 | 4/1983 | Otsuka et al. | 123/571 |
| 4,399,791 | 8/1983 | Kobayashi | 123/571 X |

FOREIGN PATENT DOCUMENTS

| | | | |
|---|---|---|---|
| 53-76228 | 7/1978 | Japan | 123/571 |
| 54-16026 | 2/1979 | Japan | 123/571 |
| 55-93950 | 6/1980 | Japan | 123/571 |
| 55-151146 | 11/1980 | Japan | 123/571 |
| 57-168033 | 10/1982 | Japan | 123/571 |
| 2006988 | 5/1979 | United Kingdom | 123/571 |

*Primary Examiner*—Wendell E. Burns

*Attorney, Agent, or Firm*—Arthur L. Lessler

[57] ABSTRACT

A method and a system for electronically controlling the quantity of fuel being supplied to an internal combustion engine equipped with an exhaust gas recirculation control system. A plurality of sets of basic values of fuel quantity are stored beforehand, which are set as a function of at least two parameters indicative of operating conditions of the engine, for selection in response to the rate of recirculation of exhaust gases being effected by the exhaust gas recirculation control system. Read from a selected set of basic values of fuel quantity is a basic value of fuel quantity which corresponds to actual values of the above at least two parameters detected, and a quantity of fuel is supplied to the engine, which corresponds to the read basic value of fuel quantity.

16 Claims, 7 Drawing Figures

5
CPU
503
ROM
507
RAM
508
DRIVING CIRCUIT
509
DRIVING CIRCUITS
511
FUEL INJECTION VALVES
6
SELECTOR VALVE
22
SELECTOR VALVE
27
510
Me COUNTER
502
A/D CONVERTER
506
MULTI-PLEXER
505
DATA INPUT CIRCUIT
513
WAVEFORM SHAPER
501
LEVEL SHIFTER UNIT
504
LEVEL SHIFTER UNIT
512
Ne SENSOR
11
θTH SENSOR
4
PBA SENSOR
8
TW SENSOR
10
VEHICLE SPEED SENSOR
SW1

FIG. 6

| Ne \ $P_{BA}$ | $P_{BA1}$ | --- | $P_{BAj}$ | --- | $P_{BA17}$ |
|---|---|---|---|---|---|
| $N_1$ | $T_{M11}$ | | | | |
| ⋮ | | | | | |
| $N_i$ | | | $T_{Mij}$ | | |
| ⋮ | | | | | |
| $N_{16}$ | | | | | $T_{M16.17}$ |

FIG. 7

| Ne \ $P_{BA}$ | $P_{BA2}$ | --- | $P_{BAj}$ | --- | $P_{BA13}$ |
|---|---|---|---|---|---|
| $N_5$ | $T_{EM5.2}$ | | | | |
| ⋮ | | | | | |
| $N_i$ | | | $T_{EMij}$ | | |
| ⋮ | | | | | |
| $N_{14}$ | | | | | $T_{EM14.13}$ |

FUEL SUPPLY CONTROL METHOD AND SYSTEM FOR INTERNAL COMBUSTION ENGINES EQUIPPED WITH EXHAUST GAS RECIRCULATION CONTROL SYSTEMS

BACKGROUND OF THE INVENTION

This invention relates to fuel supply control for internal combustion engines equipped with exhaust gas recirculation control systems, and more particularly to a method and a system for control of the fuel sypply to such engines, which is adapted to supply fuel to the engine in a quantity appropriate to an actual quantity of recirculating exhaust gases, to thereby improve the emission characteristics, driveability, fuel consumption, etc. of the engine.

A fuel supply control system adapted for use with an internal combustion engine, particularly a gasoline engine has been proposed e.g. by U.S. Pat. No. 3,483,851, which is adapted to determine the fuel injection period of a fuel injection device for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

It is also known to return part of exhaust gases emitted from the engine from the exhaust passage to the intake passage through an exhaust gas recirculating passage during operation of the engine so as to refrain an excessive rise in the combustion temperature of the air/fuel mixture within the engine cylinders, to thereby prevent generation of nitrogen oxides forming a factor of air pollution, as generally abbreviated as "EGR".

While this exhaust gas recirculation is an effective anti-pollution measure, it has disadvantages as follows: If exhaust gas recirculation is carried out when the temperature of the engine is low, the combustion within the engine cylinders can become unstable, resulting in a degradation in the driveability of the engine. Therefore, at a low engine temperature, the exhaust gas recirculation should be prohibited. Further, during high speed operation of the engine, the rate of recirculation of exhaust gases has to be reduced so as to secure a required engine output and high fuel economy, as well as to maintain desired emission characteristics of the engine. By these reasons, the rate of recirculation of exhaust gases should be varied in response to varying operating condition of the engine so as to always obtain desired amounts of recirculating exhaust gases best suited for various operating conditions of the engine.

If the rate of recirculation of exhaust gases is thus varied, the substantial intake air quantity, that is, the amount of oxygen that effectively contributes to combustion within the engine cylinders varies in response to changes in the rate of recirculation of exhaust gases, even if the absolute pressure in the intake pipe, that is, the intake air quantity into the engine cylinders remains unchanged. Therefore, the quantity of fuel being supplied to the engine should be controlled to appropriate values in response to actual values of rate of recirculation of exhaust gases.

SUMMARY OF THE INVENTION

It is an object of the invention to provide a fuel supply control method for an internal combustion engine, which is adapted to control the fuel supply quantity to values appropriate to values of rate of recirculation of exhaust gases which are set in response to operating conditions of the engine, thereby improving various operating characteristics of the engine such as emission characteristics, driveability and fuel consumption.

It is a further object of the invention to provide an electronic fuel supply control system for an internal combustion engine, which is arranged in combination with an exhaust gas recirculation control system adapted to control the exhaust gas recirculation quantity in response to operating conditions of the engine, for controlling the quantity of fuel being supplied to the engine to values appropriate to operating conditions of the engine, in response to a quantity of recirculating exhaust gases controlled by the above exhaust gas recirculation control system.

The present invention provides a method for electronically controlling the quantity of fuel being supplied to an internal combustion engine equipped with an exhaust gas recirculation control means for controlling the recirculation of exhaust gases from the exhaust passage of the engine to an intake passage thereof, the method being characterized by comprising the following steps: (1) storing beforehand a plurality of sets of basic values of fuel quantity set as a function of at least first and second parameters indicative of operating conditions of the engine; (2) detecting actual values of the above at least first and second parameters; (3) detecting a value of rate of recirculation of exhaust gases being recirculated by the exhaust gas recirculation control means; (4) selecting one of the above plurality of sets of basic values of fuel quantity, which corresponds to a value of rate of recirculation of exhaust gases detected in the step (3); (5) reading from the selected one set of basic values of fuel quantity a basic value of fuel quantity corresponding to values of the at least first and second parameters detected in the step (2); and (6) supplying a fuel quantity corresponding to a basic value of fuel quantity read in the step (5).

Preferably, the method according to the invention further includes the steps of detecting a value of a third parameter indicative of operating conditions of the engine, selecting one of first and second values of rate of recirculation of exhaust gases in response to a value of the third parameter detected, the above second value of rate of recirculation of exhaust gases being larger than the above first value thereof, and recirculating the exhaust gases from the exhaust passage to the intake passage at one of the above first and second values of rate of recirculation of exhaust gases selected, wherein the step (4) comprises selecting a first set of basic values of fuel quantity when the first value of rate of recirculation of exhaust gases is selected, and selecting a second set of basic values of fuel quantity when the second value of recirculation of exhaust gases is selected. The second set of basic values of fuel quantity is smaller in value than the first set of basic values of fuel quantity so far as they correspond to the same combination of values of the at least first and second parameters.

The third parameter includes the temperature of the engine and a parameter indicative of a predetermined decelerating condition of the engine requiring interruption of the fuel supply to the engine, for instance, pressure in the intake pipe of the engine.

Further, preferably, the method according to the invention further includes detecting a value of third and fourth parameters indicative of operating conditions of the engine, selecting one of first, second and third values of rate of recirculation of exhaust gases in response to values of the third and fourth parameters detected, the first, second and third values of rate of recirculation of exhaust gases being set at larger values in said order, and recirculating the exhaust gases from the exhaust passage to the intake passage at one of the first, second and third values of rate of recirculation of exhaust gases selected, wherein the step (4) comprises selecting first, second and third sets of basic values of fuel quantity, respectively, when the first, second and third values of rate of recirculation of exhaust gases is selected. The first, second and third sets of basic values of fuel quantity are set at smaller values in said order so far as they correspond to the same combination of values of the at least first and second parameters. The third parameter includes a parameter indicative of a predetermined decelerating condition of the engine requiring interruption of the fuel supply to the engine, for instance pressure in the intake passage of the engine, and the fourth parameter is the speed of a vehicle on which the engine is installed.

The invention further provides an electronic fuel supply control system for an internal combustion engine which is equipped with exhaust gas recirculation control means for controlling the recirculation of part of exhaust gases emitted from the engine from the exhaust passage of the engine to an intake passage thereof.

A first form of the exhaust gas recirculation control means includes an exhaust gas recirculating passage communicating the exhaust passage with the intake passage, a control valve arranged in the exhaust gas recirculating passage for controlling the quantity of exhaust gases being recirculated, means for generating hydraulic pressure, means responsive to the hydraulic pressure for selectively closing and opening the control valve, a communication passage for supplying the hydraulic pressure generated by the hydraulic pressure generating means to the hydraulic pressure responsive means, an electromagnetic valve arranged in the communication passage and operable to allow supply of the hydraulic pressure to the hydraulic pressure responsive means when energized, and to allow supply of atmospheric pressure to the hydraulic pressure responsive means when deenergized, means for detecting a value of a first parameter indicative of operating conditions of the engine and generating a first signal indicative of a detected value of the first parameter, and control means responsive to the first signal from the first parameter value detecting means, for generating a driving signal for energizing the electromagnetic valve, and fuel supply means for supplying fuel to the engine.

The electronic fuel supply control system according to one embodiment of the invention, which is adapted to control the first form of exhaust gas recirculation control means, comprises: driving means for driving fuel supply means for supplying fuel to the engine; means for detecting a value of a second parameter indicative of operating conditions of the engine and generating a second signal indicative of a detected value of the second parameter; means for detecting a value of a third parameter indicative of operating conditions of the engine and generating a third signal indicative of a detected value of the third parameter; storage means storing first and second sets of basic values of fuel quantity set as a function of at least the second and third parameters; means for selecting the first set of basic values of fuel quantity when the driving signal for energizing the electromagnetic valve is not generated, and selecting the second set of basic values of fuel quantity when the driving signal is generated; and means for reading from the selected set of basic values of fuel quantity a basic value of fuel quantity corresponding to at least detected values of the second and third parameters from the second and third parameter value detecting means and supplying a signal indicative of the read basic value of fuel quantity to the driving means. The driving means is adapted to drive the fuel supply means to supply a quantity of fuel corresponding to the read basic value of fuel quantity to the engine. The second set of basic values of fuel quantity stored in the storage means is smaller in value than the first set of basic values of fuel quantity stored in the storage means so far as they correspond to the same combination of values of the at least second and third parameters.

The above first parameter includes the temperature of the engine, a parameter indicative of a predetermined decelerating condition of the engine requiring interruption of the fuel supply to the engine, for instance pressure in the intake passage of the engine.

A second form of the exhaust gas recirculation control means provides an arrangement which is mainly distinguished from the aforementioned first form in that it additionally or alternatively includes switching means switchable between two positions and arranged in the communication passage at a location between the electromagnetic valve and the hydraulic pressure responsive means, for changing the magnitude of the hydraulic pressure at two different rates and supplying the changed hydraulic pressure to the hydraulic pressure responsive means, means for detecting a value of a second parameter indicative of operating conditions of the engine and generating a second signal indicative of a detected value of the second parameter, and control means responsive to the first and second signals from the first and second parameter value detecting means, for generating a driving signal for energizing the electromagnetic valve, and a command signal commanding selection of the two positions of the switching means.

The electronic fuel supply control system according to a second embodiment adapted to control the second form of exhaust gas recirculation control means comprises: driving means for driving the fuel supply means; means for detecting a value of a third parameter indicative of operating conditions of the engine and generating a third signal indicative of a detected value of the third parameter; means for detecting a value of a fourth parameter indicative of operating conditions of the engine and generating a fourth signal indicative of a detected value of the fourth parameter; storage means storing first, second and third sets of basic values of fuel quantity set as a function of at least the third and fourth parameters; means for selecting the first set of basic values of fuel quantity when the driving signal for energizing the electromagnetic valve is not generated, selecting the second and third sets of basic values of fuel quantity when the above driving signal is generated in a manner selecting the second set of basic values of fuel quantity when the command signal is generated which commands selection of one of the two positions of the switching means at which the hydraulic pressure is changed at a first rate, and selecting the third set of basic values of fuel quantity when the command signal is generated which commands selection of the other of the two positions of the switching means at which the hydraulic pressure is changed at a second rate which is smaller than the first rate; and means for reading from the selected set of basic values of fuel quantity a basic value of fuel quantity corresponding to at least detected values of the third and fourth parameters from the third and fourth parameter value detecting means, and supplying a signal indicative of the read basic value of fuel quantity to the driving means. The driving means is adapted to drive the fuel supply means to supply a quantity of fuel corresponding to the read basic value of fuel quantity to the engine. The first, second and third sets of basic values of fuel quantity stored in the storage means are set at smaller values in said order so far as they correspond to the same combination of values of the at least third and fourth parameters.

The above first parameter includes a parameter indicative of a predetermined decelerating condition of the engine requiring interruption of the fuel supply to the engine, and the above second parameter includes the speed of a vehicle on which the engine is installed.

The above and other objects, features and advantages of the invention will be more apparent from the ensuing detailed description taken in conjunction with the accompanying drawings.

BRIEF DESCRIPTION OF THE DRAWINGS

FIG. 6 is a view showing a map of basic fuel injection period of fuel injection valves set as a function of intake pipe absolute pressure PBA and engine rpm Ne, applicable when the exhaust gas recirculation is not effected; and FIG. 7 is a view showing a map of basic fuel injection period of fuel injection valves set as a function of intake pipe absolute pressure PBA and engine rpm Ne, applicable when the exhaust gas recirculation is effected.

DETAILED DESCRIPTION

The invention will now be described in detail with reference to the drawings.

Figure 1:
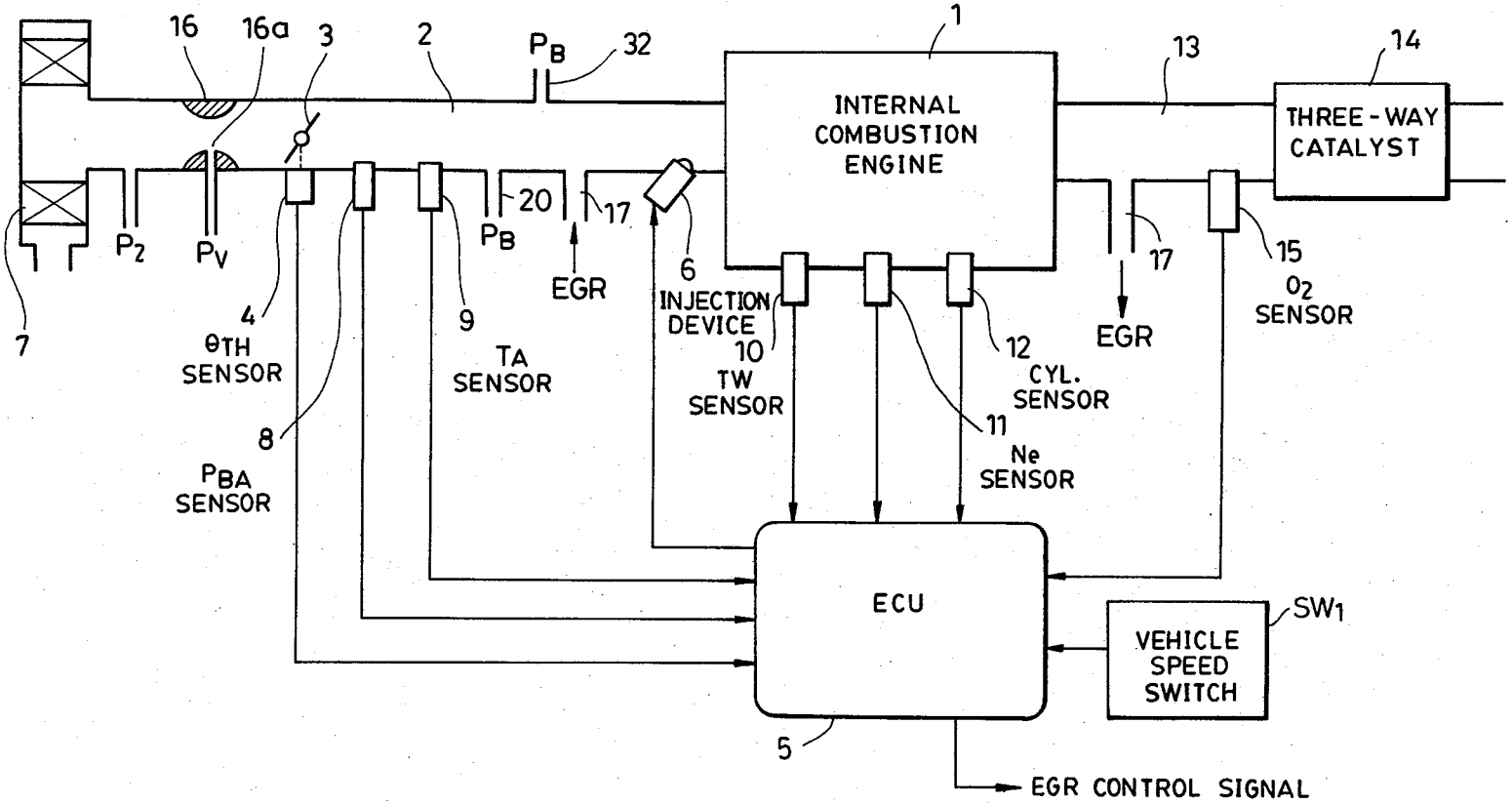
FIG. 1 is a block diagram illustrating the whole arrangement of an electronic fuel supply control system according to an embodiment of the invention.

Referring first to FIG. 1, there is illustrated the whole arrangement of a fuel supply control system for internal combustion engines according to the invention. Reference numeral 1 designates an internal combustion engine which may be a four-cylinder type, for instance. An intake pipe 2 is connected to the engine 1, in which is arranged a throttle valve 3, which in turn is coupled to a throttle valve opening (TH) sensor 4 for detecting its valve opening and converting same into an electrical signal which is supplied to an electronic control unit (hereinafter called "ECU") 5.

Fuel injection valves 6 are arranged in the intake pipe 2 at a location between the engine 1 and the throttle valve 3, which correspond in number to the engine cylinders and are each arranged at a location slightly upstream of an intake valve, not shown, of a corresponding engine cylinder. These fuel injection valves are connected to a fuel pump, not shown, and also electrically connected to the ECU 5 in a manner having their valve opening periods or fuel injection quantities controlled by signals supplied from the ECU 5.

The intake pipe 2 has one end opening in the atmosphere and provided with an air cleaner 7, and a venturi 16 is provided in the intake pipe 2 at a location between the air cleaner 7 and the throttle valve 3.

On the other hand, an absolute pressure sensor (PBA) 8 communicates with the interior of the intake pipe at a location immediately downstream of the throttle valve 3. The absolute pressure sensor 8 is adapted to detect absolute pressure in the intake pipe 2 and applies an electrical signal indicative of detected absolute pressure to the ECU 5. An intake air temperature (TA) sensor 9 is arranged in the intake pipe 2 at a location downstream of the absolute pressure sensor 8 and also electrically connected to the ECU 5 for supplying thereto an electrical signal indicative of detected intake air temperature.

An engine temperature (TW) sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine speed sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle of the engine each time the engine crankshaft rotates through 180 degrees, i.e., upon generation of each pulse of a top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 is a vehicle speed switch SW1 which is adapted to supply an on-state signal to the ECU 5 when the speed of a vehicle, not shown, on which the engine 1 is installed, exceeds 45 km/h for instance.

An exhaust gas recirculating passage 17 opens in the exhaust pipe 13 at a location upstream of the three-way catalyst 14 and leads to the intake pipe 2 at a location downstream of the throttle valve 3, through which is returned part of exhaust gases from the exhaust pipe 13 to the intake pipe 2 in a manner being controlled in quantity by an exhaust gas recirculation control system, hereinafter described, which is arranged across the exhaust gas recirculating passage 17.

The ECU 5 operates on output signals from the aforementioned various sensors and the vehicle speed switch SW1 to determine operating conditions of the engine and supply a control signal to the exhaust gas recirculation control system as well as calculate the fuel injection period TOUT of fuel injection valves 6 by the use of the following equation, on the basis of results of the determined operating conditions of the engine:

$$TOUT = Ti \times K1 + K2 \quad (1)$$

where Ti represents a basic value of the fuel injection period which is calculated as a function of values of intake pipe absolute pressure PBA and engine rpm Ne, selected from a map of values of basic fuel injection period Ti in response to operating conditions of the exhaust gas recirculation control system, as hereinafter described, and K1, K2 represent correction coefficients, values of which are calculated in response to values of output signals from the aforementioned various sensors, that is, the throttle valve opening sensor 4, the intake pipe absolute pressure sensor 8, the intake air temperature sensor 9, the engine water temperature sensor 10, the Ne sensor 11, the cylinder-discriminating sensor 12, and the $O_2$ sensor 15 by respective equations, so as to achieve optimum operating characteristics of the engine such as startability, emission characteristics, fuel consumption and accelerability.

The ECU 5 operates on values of the fuel injection period TOUT calculated as above to supply driving signals to the fuel injection valves 6 to energize same.

Figure 2:
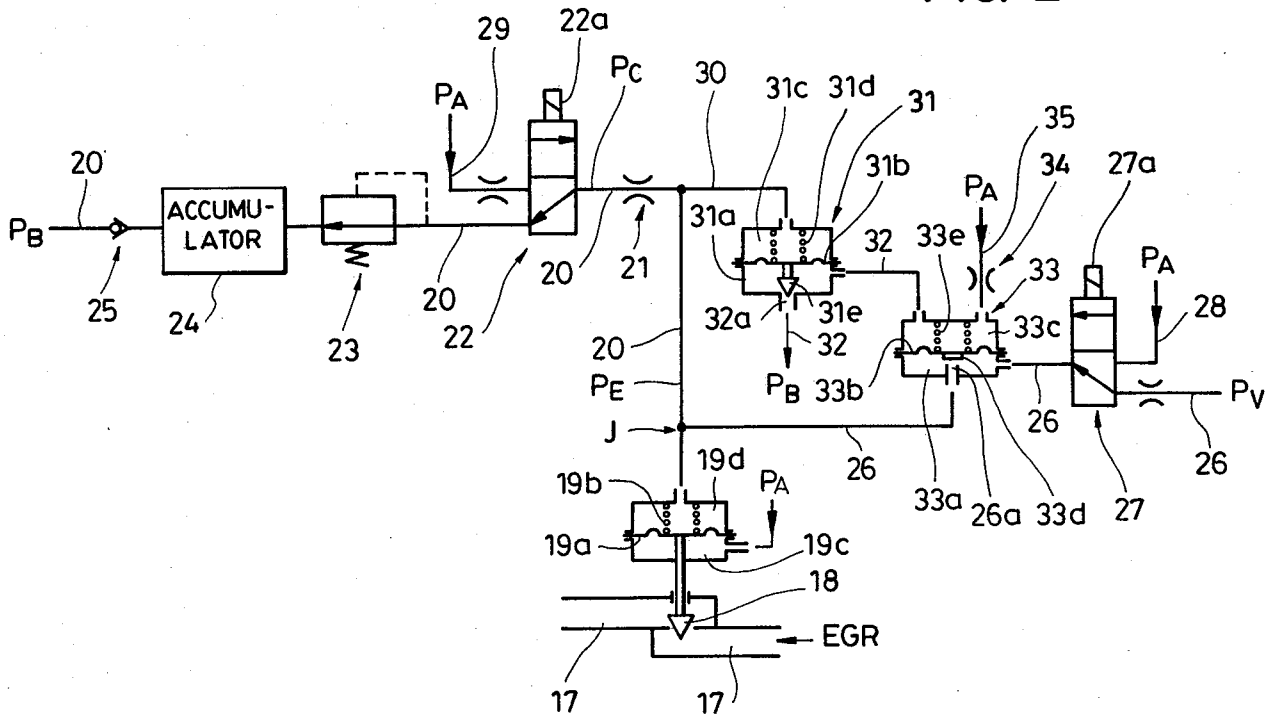
FIG. 2 is a block diagram illustrating the arrangement of an exhaust gas recirculation control system associated with the fuel supply control system of FIG. 1.

FIG. 2 shows the construction of the exhaust gas recirculation control system. A control valve 8 is arranged in the exhaust gas recirculating passage 17, for controlling the quantity of exhaust gases being recirculated, which is coupled to a diaphragm 19*a* of a vacuum-responsive actuator 19. The vacuum-responsive actuator 19 has a vacuum chamber 19*d* and a lower chamber 19*c*, both defined in part by the diaphragm 19*a*. A spring 19*b* is disposed within the vacuum chamber 19*d* in a manner urging the diaphragm 19*a* in a direction of closing the control valve 18. The lower chamber 19*c* communicates with the atmosphere, while the vacuum chamber 19*d* is arranged for communication with the interior of the intake pipe 2 at a zone downstream of the throttle valve 3 by way of a communication passage 20. Arranged in the communication passage 20 are an orifice 21, a solenoid-operated selector valve 22, a pressure-regulating valve 23, an accumulator 24 and a check valve 25 in the order mentioned. The solenoid-operated selector valve 22 has a solenoid 22*a* electrically connected to the ECU 5 in FIG. 1 and operates such that when the solenoid 22*a* is energized by a command signal from the ECU 5, the valve 22 assumes a valve position wherein the communication passage 20 communicates with the interior of the intake pipe 2, whereas when the solenoid 22*a* is deenergized, the valve assumes another valve position wherein the communication passage 20 communicates with the atmosphere through an atmosphere-communicating passage 29. The accumulator 24 normally has its internal pressure kept at a negative level due to a vacuum or negative pressure PB which is generated in the intake pipe 2 at a zone downstream of the throttle valve 3 and introduced thereinto through the check valve 25. While the communication passage 20 is opened with energization of the solenoid 22*a* of the solenoid-operated selector valve 22, the vacuum from the accumulator 24 is regulated to a predetermined constant value $P_C$, for instance 120 mmHg by the action of the pressure-regulating valve 23 and applied to the selector valve 22. Thus, the vacuum from the accummulator 24 is kept at the constant value $P_C$, irrespective of operating condition of the engine.

A pressure-changing passage 26 is connected at one end to the junction J between the orifice 21 in the communication passage 20 and the vacuum-responsive actuator 19, which passage is connected at the other end to an opening 16*a* in the venturi 16 in the intake pipe 2 in FIG. 1, via a pressure-regulating valve 33 and a solenoid-operated selector valve 27, both arranged across the same passage 26. The selector valve 27 has a solenoid 27*a* electrically connected to the ECU 5 and operates such that when the solenoid 27*a* is energized by a command signal from the ECU 5, the valve 27 assumes a valve position wherein the pressure-changing passage 26 communicates with the interior of the intake pipe 2 at the venturi 16, whereas when the solenoid 27*a* is deenergized, the valve 27 assumes another valve position wherein the pressure-changing passage 26 communicates with the atmosphere via the selector valve 27 and an atmosphere-communicating passage 28. The pressure-regulating valve 33 is comprised of a valve chamber 33*a* formed across the pressure-changing passage 26, a vacuum chamber 33*c* defined in part by a diaphragm 33*b* separating the chamber 33*c* from the chamber 33*a*, a flat valve body 33*d* attached on the diaphragm 33*b* and disposed to close and open an opening 26*a* of the pressure-changing passage 26 on the side of the vacuum-responsive actuator 19 in response to displacement of the diaphragm 33*b*, and a spring 33*e* mounted within the vacuum chamber 33*c* and urging the valve body 33*d* in the closing direction. Connected to the vacuum chamber 33*c* are a passage 35 communicating with the atmosphere via an orifice 34 and a vacuum passage 32 commnunciating with the interior of the intake pipe 2 at a zone downstream of the throttle valve 3 in FIG. 1. A vacuum-responsive air valve 31 is arranged across the vacuum passage 32 which is comprised of a valve chamber 31*a*, a vacuum chamber 31*c* defined in part by a diaphragm 31*b* separating the chamber 31*c* from the chamber 31*a*, a valve body 31*e* attached on the diaphragm 31*b* and disposed to close and open an opening 32*a* of the vacuum passage 32 on the side of the intake pipe 2 with displacement of the diaphragm 31*b*, and a spring 31*d* mounted within the vacuum chamber 31*c* and urging the valve body 31*e* in the closing direction. Connected to the vacuum chamber 31*c* is a branch passage 30 branching off from the communication passage 20 at a location between the orifice 21 and the junction J.

When both of the solenoids 22*a*, 27*a* of the solenoid-operated selector valves 22, 27 are energized at the same time, the pressure-regulating valve 33, the air valve 31 and the vacuum-responsive actuator 19 operate in the following manner: The predetermined pressure $P_C$ regulated by the pressure-regulating valve 23 is introduced into the vacuum chamber 31*c* of the air valve 31 so that the valve body 31*e* of the air valve 31 opens the vacuum passage 32 in response to the difference between pressures acting upon the opposite side surfaces of the diaphragm 31*b*. When the valve body 31*e* opens the vacuum passage 32, a vacuum occurs in the vacuum chamber 33*c* of the pressure-regulating valve 33 due to the vacuum PB in the intake pipe 2 at a zone downstream of the throttle valve 3. The magnitude of the vacuum in the vacuum chamber 33*c* depends upon the valve opening of the air valve 31 and the magnitude of the vacuum PB. When the difference between the vacuum in the vacuum chamber 33c of the pressure-regulating valve 33 and the pressure in the valve chamber 33a of same, that is, the pressure $P_V$ at the venturi 16 of the intake pipe 2, exceeds a predetermined value, the diaphragm 33b of the pressure-regulating valve 33 is upwardly displaced as viewed in FIG. 2 to open the opening 26a so that the pressure $P_V$ is introduced into the communication passage 20 via the pressure-changing passage 26. This pressure $P_V$ dilutes or reduces the pressure $P_C$ regulated by the pressure-regulating valve 23 into a pressure $P_E$, and the pressure $P_E$ is introduced into the vacuum chamber 19d of the vacuum-responsive actuator 19 as operating vacuum.

Due to the above dilution of the pressure $P_C$, the vacuum in the vacuum chamber 31c of the air valve 31 decreases and accordingly the valve opening of the air valve 31 is reduced so that the vacuum in the valve chamber 31a and accordingly the vacuum in the vacuum chamber 33c of the pressure-regulating valve 33 decrease. Thus, the valve body 33d is displaced to close the opening 26a. Then, the predetermined pressure $P_C$ is no longer changed by the pressure $P_V$ so that the vacuum $P_E$ increases (that is, the absolute pressure decreases). The same action as above is repeated, and thus the operating vacuum $P_E$ is regulated to a constant value which is proportionate to a quantity of intake air being sucked into the engine 1.

In other words, when the intake air quantity into the engine 1 is small with the throttle valve 3 in its closed position, a large vacuum $P_B$ occurs in the intake pipe 2 at a zone downstream of the throttle valve 3, and at the same time, the flow velocity through the venturi 16 drops. Accordingly, the vacuum $P_V$ decreases (the absolute pressure increases) so that the difference between pressures acting upon the opposite side surfaces of the diaphragm 33b of the pressure-regulating valve 33 becomes larger to displace the valve body 33d in its opening direction, thereby reducing the operating vacuum $P_E$ for the vacuum-responsive actuator 19. On the contrary, when the intake air quantity increases, the vacuum $P_V$ increases correspondingly so that the valve body 33d of the pressure-regulating valve 33 is displaced in its closing direction, thereby increasing the operating vacuum $P_E$. The diaphragm 19a of the vacuum-responsive actuator 19 is displaced in response to the magnitude of the operating vacuum $P_E$ so as to regulate the valve opening of the control valve 18. Thus, exhaust gases can always be recirculated at a constant rate which is proportionate to a quantity of intake air being sucked to the engine 1, so long as the intake air quantity remains constant.

Next, when the solenoid 22a of the solenoid-operated selector valve 22 is energized while simultaneously the solenoid 27a of the other solenoid-operated selector valve 27 is deenergized, the pressure-changing passage 26 is allowed to communicate with the atmosphere via the passage 28 to introduce atmospheric pressure into the valve chamber 33a of the pressure-regulating valve 33. Consequently, the valve body 33d is displaced to open the opening 26a, whereby the operating vacuum $P_E$ drops and accordingly the valve opening of the control valve 18 is reduced, resulting in a reduction in the exhaust gas recirculation quantity.

When the solenoid 22a of the solenoid-operated selector valve 22 is deenergized, the communication passage 20 is allowed to communicate with the atmosphere via the air passage 29 to cause replacement of the operating vacuum $P_E$ by atmospheric pressure so that the control valve 18 becomes closed, resulting in interruption of the exhaust gas recirculation.

In the way described above, by controlling the energization of the solenoids 22a, 27a of the solenoid-operated selector valves 22, 27, the rate of recirculation of exhaust gases can be selected at desired values.

Although in the foregoing embodiment the lower chamber 19c of the vacuum-responsive actuator 19 and the atmospheric pressure passages 28, 29 and 35 are all in communication with the atmosphere, they may alternatively be diposed in communication with the interior of the intake pipe 2 at a zone upstream of the venturi 16 so as to utilize the pressure $P_2$ occurring there in place of the atmospheric pressure $P_A$. If the invention is applied to an internal combustion engine equipped with a supercharger, this alternative pressure $P_2$ may preferably be supercharged pressure in the intake pipe at a zone upstream of the venturi 16 and downstream of the supercharger.

Further, although in the embodiment the vacuum chamber 19d of the vacuum-responsive actuator 19 is supplied with the vacuum $P_B$ in the intake pipe 2 downstream of the throttle valve 3 through the communication passage 20, etc. after having been temporarily stored in the accumulator 24 connected to the intake pipe 2, such vacuum PB may be replaced by a vacuum having a constant value generated by a vacuum pump or by a compressed air pressure supplied from an air compressor. Such compressed air pressure may be stored in the accumulator 24 and then the communication passage 20 may be connected to the lower chamber 19c instead of the vacuum chamber 19d of the vacuum-responsive actuator 19, while the vacuum chamber 19d is now communicated with the atmosphere. Even with this alternative arrangement, control of the exhaust gas recirculation similar to that described above can be effected by controlling the energization of the solenoid-operated selector valves 22, 27.

Figure 3:
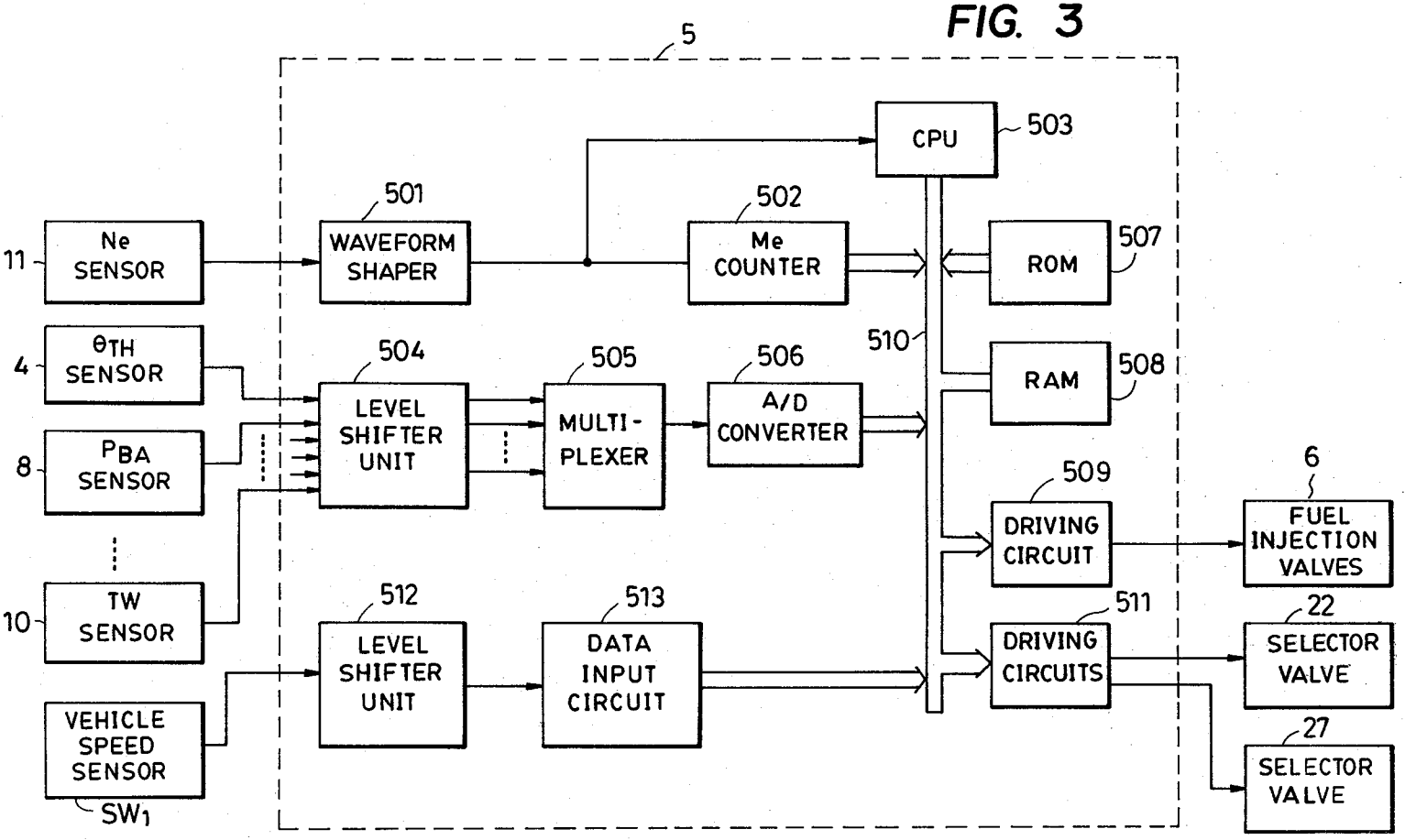
FIG. 3 is a block diagram illustrating the internal arrangement of an electronic control unit (ECU) appearing in FIG. 1.

FIG. 3 shows a circuit configuration within the ECU 5 in FIG. 1. An output signal indicative of the engine rotational speed from the Ne sensor 11 in FIG. 1 is applied to a waveform shaper 501, wherein it has its pulse waveform shaped, and supplied to a central processing unit (hereinafter called "CPU") 503 as the TDC signal, as well as to an Me value counter 502. The Me value counter 502 counts the interval of time between a preceding pulse of the TDC signal and a present pulse of the same signal, inputted thereto from the Ne sensor 11, and therefore its counted value Me corresponds to the reciprocal of the actual engine rotational speed Ne. The Me value counter 502 supplies the counted value Me to the CPU 503 via a data bus 510.

The respective output signals from the throttle valve opening sensor 4, the intake pipe absolute pressure PBA sensor 8, the engine coolant temperature sensor 10, etc. have their voltage levels successively shifted to a predetermined voltage level by a level shifter unit 504 and applied to an analog-to-digital converter 506 through a multiplexer 505. The analog-to-digital converter 506 successively converts into digital signals analog output voltages from the aforementioned various sensors, and the resulting digital signals are supplied to the CPU 503 via the data bus 510.

A signal from the vehicle speed switch SW1 in FIG. 1, indicative of the on and off positions of same has its voltage level shifted to a predetermined level by another level shifter 512, then converted into a predetermined signal by a data input circuit 513 and supplied to the CPU 503 via the data bus 510.

Further connected to the CPU 503 via the data bus 510 are a read-only memory (hereinafter called "ROM") 507, a random access memory (hereinafter called "RAM") 508 and driving circuits 509 and 511. The RAM 508 temporarily stores various calculated values from the CPU 503, while the ROM 507 stores a control program executed within the CPU 503 as well as a TM map of a basic fuel injection period for the fuel injection valves 6, the values of which are set as a function of the recirculation quantity of exhaust gases, as hereinafter referred to, as well as first and second TEM maps, also hereinafter referred to, etc.

The CPU 503 executes the control program stored in the ROM 507 in response to the values of the aforementioned various engine operation parameter signals to determine operating conditions of the engine for supplying command signals to the driving circuit 511 for energization of the solenoid-operated selector valves 22, 27 and calculate the fuel injection period TOUT for the fuel injection valves 6 in response to the actual quantity of recirculating exhaust gases, and supplies the calculated value of fuel injection period to the driving circuit 509 via the data bus 510. The driving circuit 509 is responsive to this calculated value to supply driving signals to the fuel injection valves 6 to energize or deenergize same. On the other hand, the driving circuit 511 supplies driving signals to the solenoid-operated selector valves 22, 27 to energize or deenergize same.

Figure 4:
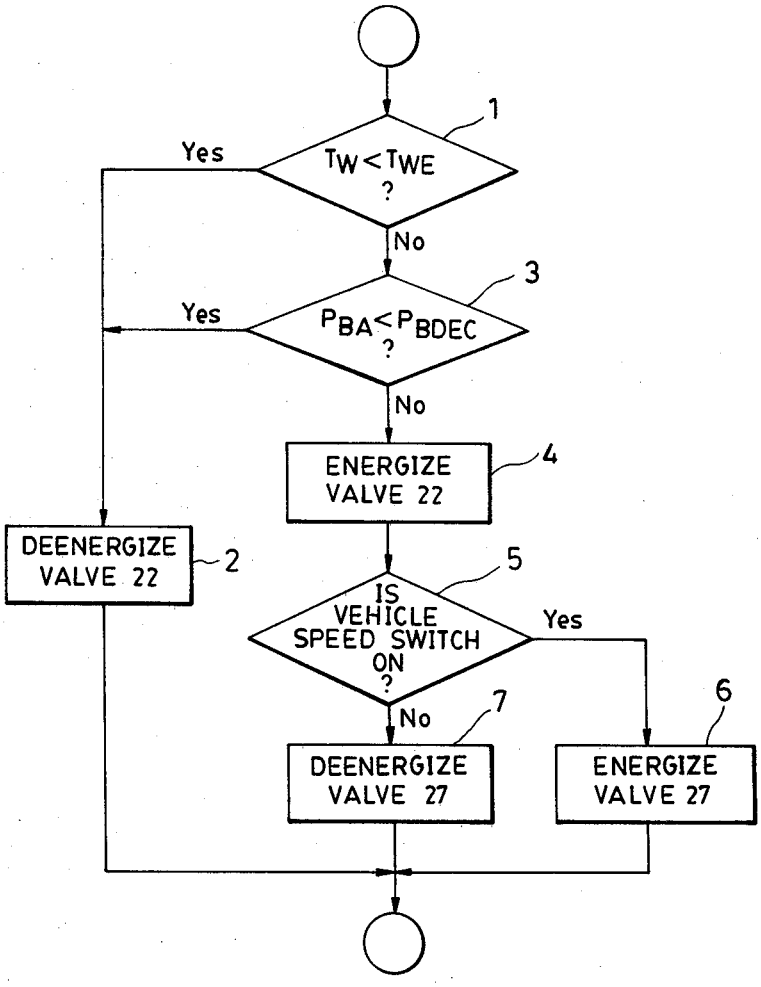
FIG. 4 is a flow chart showing a manner of exhaust gas recirculation control.

FIG. 4 shows a flow chart of control of the solenoid-operated selector valves 22, 27, i.e. the quantity of recirculating exhaust gases, which is executed by the CPU 503. First, it is determined at the step 1 whether or not the engine coolant temperature signal TW from the engine temperature sensor 10 is lower than a predetermined value TWE. This determination is necessary because recirculation of exhaust gases at low engine temperature can cause unstable combustion within the engine cylinders to deteriorate the driveability of the engine. If the engine temperature is determined to be lower than the predetermined value TWE, that is, if the answer to the question of the step 1 is affirmative, the solenoid 22*a* of the selector 22 is deenergized at the step 2, to interrupt the exhaust gas recirculation. If the answer to the question of the step 1 is negative, it is then determined at the step 3 whether or not the intake pipe absolute pressure PBA is lower than a predetermined value PBDEC (e.g. 260 mmHg). An affirmative answer to this question means that the engine is decelerating. Since at deceleration of the engine the exhaust gas recirculation should be interrupted so as to avoid unstable combustion within the engine cylinders, the program then proceeds to the step 2 to deenergize the solenoid 22*a* of the solenoid-operated selector valve 22.

If the answer to the question of the step 3 is negative, the solenoid 22*a* of the selector valve 22 is energized at the step 4. Then, the program proceeds to the step 5 wherein the on-off position of the vehicle speed switch SW1 is determined. If the vehicle speed switch is on, that is, if the vehicle speed is lower than 45 km/h, the solenoid 27*a* of the selector valve 27 is energized at the step 6 to cause the vacuum $P_V$ in the intake pipe 2 at the venturi 16 to be introduced into the communication passage 20 via the pressure-changing passage 26 so that the operating pressure $P_E$ for actuating the vacuum-responsive actuator 19 is generated, which is formed by the vacuum $P_V$ and the predetermined pressure $P_C$ generated in the communication passage 20 upstream of the orifice 21. On the other hand, when the answer to the question of the step 5 is negative, that is, when the vehicle speed exceeds 45 km/h, the solenoid 27*a* of the selector valve 27 is deenergized at the step 7 to cause the atmospheric pressure to be introduced into the communication passage 20 through the atmospheric air passage 28 and the pressure-changing passage 26 so that the operating vacuum PE is generated, which is formed by the atmospheric pressure and the predetermined pressure $P_C$. Since this operating vacuum $P_E$ is larger when the predetermined pressure $P_C$ is diluted by the vacuum $P_V$ than when the pressure $P_C$ is diluted by the atmospheric pressure, the rate of recirculation of exhaust gases can be selectively set to two different values with respect to the intake air quantity by controlling the energization of the selector valve 27, depending upon whether or not the vehicle speed is below 45 km/h. More specifically, the rate of recirculation of exhaust gases with respect to the intake air quantity is set to a larger value at a vehicle speed below 45 km/h than at a vehicle speed exceeding 45 km/h.

Figure 5:
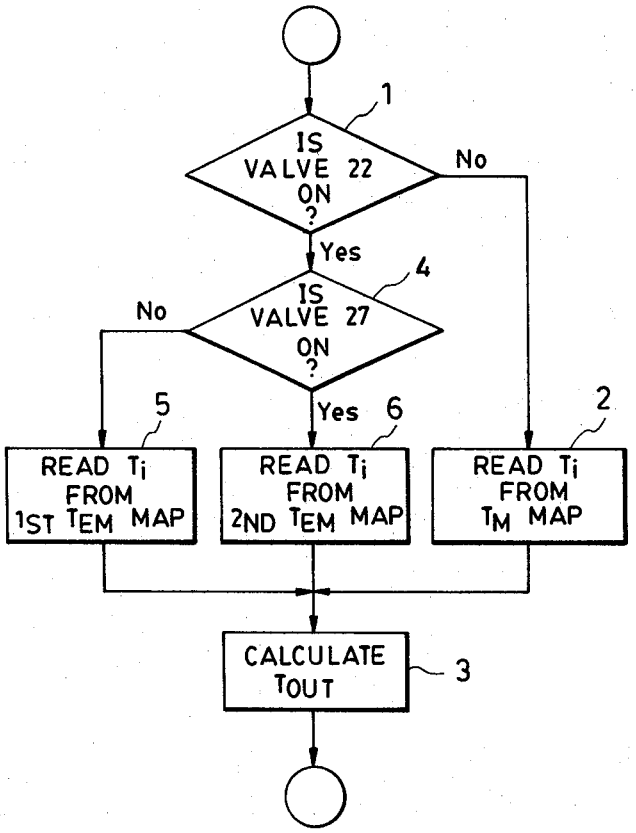
FIG. 5 is a flow chart showing a manner of calculating the fuel injection period of fuel injection valves in response to operating conditions of the exhaust gas recirculation control system.

Referring next to FIG. 5, there is shown a flow chart of a manner of calculation of the fuel injection period TOUT for the fuel injection valves 6 in response to the rate of recirculation of exhaust gases, which is executed by the CPU 503 in FIG. 3. It is first determined at the step 1 whether or not the solenoid-operated selector valve 22 is in an on state. If the answer is negative, that is, if the control valve 18 is fully closed and accordingly the exhaust gas recirculating quantity is zero, a value of basic fuel injection period Ti from the TM map stored in the ROM 507 in FIG. 3 is read at the step 2. FIG. 6 shows an example of the TM map. The values of basic fuel injection period Ti in the map are stored in an addressing area in the ROM 507 to be addressed on the basis of intake pipe absolute pressure PBA and engine rpm Ne. In the example of the TM map, seventeen predetermined values PBA1–PBA17 of intake pipe absolute pressure PBA are set within a range from 130 mmHg to 1160 mmHg, while sixteen predetermined values N1–N16 of engine rpm Ne are set within a range from 400 rpm to 6000 rpm. A value of basic fuel injection period Ti corresponding to other values of either of the engine rpm Ne and the intake pipe absolute pressure PBA is determined by an interpolation method.

A value of the basic fuel injection period Ti thus determined from the TM map is corrected by the aforementioned correction coefficients K1, K2 through multiplification and/or addition, to calculate the fuel injection period TOUT, at the step 3.

If the answer to the question of the step 1 is affirmative, that is, the solenoid-operated selector valve 22 is energized, it is determined whether or not the other selector valve 27 is also energized, at the step 4. If the answer is no, that is, if the rate of recirculation of exhaust gases with respect to the intake air quantity is the smaller one, a value of basic fuel injection period Ti is read from the first TEM map stored in the ROM 507 in FIG. 3, at the step 5. FIG. 7 shows an example of the first TEM map. Predetermined values of the basic fuel injection period Ti are stored in an array similar to that in the TM map of FIG. 6. Predetermined values of the intake pipe absolute pressure PBA and those of the engine rpm Ne are set, respectively, in twelve steps of PBA2–PBA13 and in ten steps of N5–N14. The total ranges of the respective predetermined values of the intake pipe absolute pressure PBA and the engine rpm Ne are smaller than those of the TM map of FIG. 6, because the total operating region of the engine wherein the exhaust gas recirculation is effected is smaller than that wherein it is not effected. Also in the first TEM map, an interpolation method is applied to determine a value of basic fuel injection period Ti from values of either of the intake pipe absolute pressure PBA and the engine rpm Ne falling between the respective predetermined values.

Calculation of the fuel injection period TOUT from a value of the basic fuel injection period Ti read from the first TEM map is carried out at the step 3, in a manner similar to that described above.

If the answer to the question of the step 4 is affirmative, that is, if the rate of recirculation of exhaust gases with respect to the intake air quantity is the larger one, a value of the basic fuel injection period Ti is read from the second TEM map stored in the ROM 507 in FIG. 3, at the step 6. The mapping configuration of the second TEM map is similar to that of the first TEM map, description of which is therefore omitted. A value of the basic fuel injection period Ti is processed in the same manner as described above, to calculate a final value of the fuel injection period TOUT therefrom, at the step 3.

In the above three maps, the basic fuel injection period Ti are set to smaller values in the order of the TM map, the first TEM map and the second TEM map, with respect to the same values of the intake pipe absolute pressure PBA and the engine rpm Ne.

The engine operation parameters for setting the basic fuel injection period Ti are not limited to the intake pipe absolute pressure PBA and the engine rpm Ne. For instance, the intake pipe absolute pressure PBA may be replaced by another parameter relating to the intake air quantity, such as flow rate of intake air and throttle valve opening.

Further, the invention may be applied to internal combustion engines equipped with sub combustion chambers. In such case, the exhaust gas recirculation should be not be effected in the sub intake system but should be effected only within the main intake system, in order to avoid an adverse influence of the exhaust gas recirculation upon the spark ignition of the engine.

What is claimed is:

1. A method for electronically controlling the quantity of fuel being supplied to an internal combustion engine having an intake passage, an exhaust passage, and exhaust gas recirculation control means for controlling the recirculation of part of exhaust gases emitted from said engine from said exhaust passage to said intake passage in required quantities in response to operating conditions of said engine, the method comprising the steps of: (1) storing beforehand a plurality of sets of basic values of fuel quantity set as a function of at least first and second parameters indicative of operating conditions of said engine; (2) detecting actual values of said at least first and second parameters; (3) detecting a value of rate of recirculation of exhaust gases being recirculated by said exhaust gas recirculation control means; (4) selecting one of said plurality of sets of basic values of fuel quantity, which corresponds to a value of rate of recirculation of exhaust gases detected in said step (3); (5) reading from said selected one set of basic values of fuel quantity a basic value of fuel quantity corresponding to values of said at least first and second parameters detected in said step (2); and (6) supplying a fuel quantity corresponding to a basic value of fuel quantity read in said step (5).

2. A method as claimed in claim 1, further including detecting a value of a third parameter indicative of operating conditions of said engine, selecting one of first and second values of rate of recirculation of exhaust gases in response to a value of said third parameter detected, said second value of rate of recirculation of exhaust gases being larger than said first value thereof, and recirculating said exhaust gases from said exhaust passage to said intake passage at one of said first and second values of rate of recirculation of exhaust gases selected, wherein said step (4) comprises selecting a first set of basic values of fuel quantity when said first value of rate of recirculation of exhaust gases is selected, and selecting a second set of basic values of fuel quantity when said second value of recirculation of exhaust gases is selected, said second set of basic values of fuel quantity is smaller in value than said first set of basic values of fuel quantity so far as they correspond to the same combination of values of said at least first and second parameters.

3. A method as claimed in claim 2, wherein said third parameter is the temperature of said engine, said first value of rate of recirculation of exhaust gases being selected when the temperature of said engine as said third parameter detected is smaller than a predetermined value, and said second value of rate of recirculation of exhaust gases being selected when the temperature of said engine is larger than said predetermined value.

4. A method as claimed in claim 2, wherein said third parameter is indicative of a predetermined decelerating condition of said engine requiring interruption of the fuel supply to said engine, said first value of rate of recirculation being selected when said third parameter shows a detected value indicative of said predetermined decelerating condition of said engine, and said second value of rate of recirculation of exhaust gases being selected when said third parameter shows a detected value other than said detected value indicative of said predetermined decelerating condition of said engine.

5. A method as claimed in claim 4, wherein said engine includes a throttle value arranged in said intake passage, said third parameter being pressure in said intake passage downstream of said throttle valve.

6. A method as claimed in any of claims 3–5, wherein said first value of rate of recirculation of exhaust gases is set at zero.

7. A method as claimed in claim 1, further including detecting a value of third and fourth parameters indicative of operating conditions of said engine, selecting one of first, second and third values of rate of recirculation of exhaust gases in response to values of said third and fourth parameters detected, said first, second and third values of rate of recirculation of exhaust gases being set at larger values in said order, and recirculating said exhaust gases from said exhaust passage to said intake passage at one of said first, second and third values of rate of recirculation of exhaust gases selected, wherein said step (4) comprises selecting first, second and third sets of basic values of fuel quantity, respectively, when said first, second and third values of rate of recirculation of exhaust gases is selected, said first, second and third sets of basic values of fuel quantity being set at smaller values in said order so far as they correspond to the same combination of values of said at least first and second parameters.

8. A method as claimed in claim 7, wherein said engine is installed on a vehicle, said third parameter being indicative of a predetermined decelerating condition of said engine requiring interruption of the fuel supply to said engine, said fourth parameter being the speed of said vehicle, said first value of rate of recirculation of exhaust gases being selected when said third parameter shows a detected value indicative of said predetermined decelerating condition of said engine, said second value of rate of recirculation of exhaust gases being selected when said third parameter shows a detected value other than said detected value indicative of said pedetermined decelerating condition of said engine and at the same time the speed of said vehicle shows a detected value higher than a predetermined value, and said third value of rate of recirculation of exhaust gases being selected when said third parameter shows a detected value other than said detected value indicative of said predetermined decelerating condition of said engine and at the same time the speed of said vehicle shows a detected value lower than said predetermined value.

9. A method as claimed in claim 8, wherein said engine includes a throttle valve arranged in said intake passage, said third parameter being pressure in said intake passage downstream of said throttle valve.

10. A method as claimed in claim 8, wherein said first value of rate of recirculation of exhaust gases is set at zero.

11. An electronic fuel supply control system for an internal combustion engine, said engine including an intake passage, an exhaust passage, exhaust gas recirculation control means for controlling the recirculation of part of exhaust gases emitted from said engine from said exhaust passage to said intake passage, said exhaust gas recirculation control means including an exhaust gas recirculating passage communicating said exhaust passage with said intake passage, a control valve arranged in said exhaust gas recirculating passage for controlling the quantity of exhaust gases being recirculated, means for generating hydraulic pressure, means responsive to said hydraulic pressure for selectively closing and opening said control valve, a communication passage for supplying said hydraulic pressure generated by said hydraulic pressure generating means to said hydraulic pressure responsive means, an electromagnetic valve arranged in said communication passage and operable to allow supply of said hydraulic pressure to said hydraulic pressure responsive means when energized, and to allow supply of atmospheric pressure to said hydraulic pressure responsive means when deenergized, means for detecting a value of a first parameter indicative of operating conditions of said engine and generating a first signal indicative of a detected value of said first parameter, and control means responsive to said first signal from said first parameter value detecting means, for generating a driving signal for energizing said electromagnetic valve, and fuel supply means for supplying fuel to said engine, said electronic fuel supply control system comprising: driving means for driving said fuel supply means; means for detecting a value of a second parameter indicative of operating conditions of said engine and generating a second signal indicative of a detected value of said second parameter; means for detecting a value of a third parameter indicative of operating conditions of said engine and generating a third signal indicative of a detected value of said third parameter; storage means storing first and second sets of basic values of fuel quantity set as a function of at least said second and third parameters; means for selecting said first set of basic values of fuel quantity when said driving signal for energizing said electromagnetic valve is not generated, and selecting said second set of basic values of fuel quantity when said driving signal is generated; and means for reading from said selected set of basic values of fuel quantity a basic value of fuel quantity corresponding to at least detected values of said second and third parameters from said second and third parameter value detecting means and supplying a signal indicative of said read basic value of fuel quantity to said driving means; said driving means being adapted to drive said fuel supply means to supply a quantity of fuel corresponding to said read basic value of fuel quantity to said engine; said second set of basic values of fuel quantity stored in said storage means being smaller in value than said first set of basic values of fuel quantity stored in said storage means so far as they correspond to the same combination of values of said at least second and third parameters.

12. An electronic fuel supply control system as claimed in claim 11, wherein said first parameter is the temperature of said engine, said control means being adapted to generate said driving signal when the temperature of said engine indicated by said first signal is higher than a predetermined value.

13. An electronic fuel supply control system as claimed in claim 11, wherein said first parameter is indicative of a predetermined decelerating condition of said engine requiring interruption of the fuel supply to said engine, said control means being adapted to generate said driving signal when said first signal shows a value other than a value indicative of said predetermined decelerating condition of said engine.

14. An electronic fuel supply control system as claimed in claim 13, wherein said engine includes a throttle valve arranged in said intake passage, said first parameter being pressure in said intake passage downstream of said throttle valve.

15. An electronic fuel supply control system for an internal combustion engine, said engine including an intake passage, an exhaust passage, an exhaust gas recirculation control means for controlling the recirculation of part of exhaust gases emitted from said engine from said exhaust passage to said intake passage, said exhaust gas recirculation control means including an exhaust gas recirculating passage communicating said exhaust passage with said intake passage, a control valve arranged in said exhaust gas recirculating passage for controlling the quantity of exhaust gases being recirculated, means for generating hydraulic pressure, means responsive to said hydraulic pressure for selectively closing and opening said control valve, a communication passage for supplying said hydraulic pressure generated by said hydraulic pressure generating means to said hydraulic pressure responsive means, an electromagnetic valve arranged in said communication passage and operable to allow supply of said hydraulic pressure to said hydraulic pressure responsive means when energized, and to allow supply of atmospheric pressure to said hydraulic pressure responsive means when deenergized, switching means switchable between two positions and arranged in said communication passage at a location between said electromagnetic valve and said hydraulic pressure responsive means, for changing the magnitude of said hydraulic pressure at two different rates and supplying said changed hydraulic pressure to said hydraulic pressure responsive means, means for detecting a value of a first parameter indicative of operating conditions of said engine and generating a first signal indicative of a detected value of said first parameter, means for detecting a value of a second parameter indicative of operating conditions of said engine and generating a second signal indicative of a detected value of said second parameter, and control means responsive to said first and second signals from said first and second parameter value detecting means, for generating a driving signal for energizing said electromagnetic valve, and a command signal commanding selection of said two positions of said switching means, and fuel supply means for supplying fuel to said engine, said electronic fuel supply control system comprising: driving means for driving said fuel supply means; means for detecting a value of a third parameter indicative of operating conditions of said engine and generating a third signal indicative of a detected value of said third parameter; means for detecting a value of a fourth parameter indicative of operating conditions of said engine and generating a fourth signal indicative of a detected value of said fourth parameter; storage means storing first, second and third sets of basic values of fuel quantity set as a function of at least said third and fourth parameters; means for selecting said first set of basic values of fuel quantity when said driving signal for energizing said electromagnetic valve is not generated, and selecting said second and third sets of basic values of fuel quantity when said driving signal is generated in a manner selecting said second set of basic values of fuel quantity when said command signal is generated which commands selection of one of said two positions of said switching means at which said hydraulic pressure is changed at a first rate, and selecting said third set of basic values of fuel quantity when said command signal is generated which commands selection of the other of said two positions of said switching means at which said hydraulic pressure is changed at a second rate which is smaller than said first rate; and means for reading from said selected set of basic values of fuel quantity a basic value of fuel quantity corresponding to at least detected values of said third and fourth parameters from said third and fourth parameter value detecting means, and supplying a signal indicative of said read basic value of fuel quantity to said driving means; said driving means being adapted to drive said fuel supply means to supply a quantity of fuel corresponding to said read basic value of fuel quantity to said engine; said first, second and third sets of basic values of fuel quantity stored in said storage means being set at smaller values in said order so far as they correspond to the same combination of values of said at least third and fourth parameters.

16. An electronic fuel supply control system as claimed in claim 15, wherein said engine is installed on a vehicle, said first parameter being indicative of a predetermined decelerating condition of said engine requiring interruption of the fuel supply to said engine, said second parameter being the speed of said vehicle, said control means being adapted not to generate said driving signal for energizing said electromagnetic valve when said first signal from said first parameter detecting means shows a value indicative of said predetermined decelerating condition of said engine, said control means being adapted to generate said driving signal for energizing said electromagnetic valve as well as said command signal commanding selection of said one of said two positions of said switching means when said first signal from said first parameter value detecting means shows a value other than said value indicative of said predetermined decelerating condition of said engine and at the same time the speed of said vehicle indicated by said second signal from said second parameter value detecting means shows a value higher than a predetermined value, and to generate said driving signal for energizing said electromagnetic valve as well as said command signal commanding selection of the other of said two positions of said switching means when said first signal from said first parameter value detecting means shows a value other than said value indicative of said predetermined decelerating condition of said engine and at the same time the speed of said vehicle indicated by said second signal from said second parameter value detecting means shows a value lower than said predetermined value.

* * * * *